US007682015B2

(12) United States Patent
Hoshino

(10) Patent No.: US 7,682,015 B2
(45) Date of Patent: Mar. 23, 2010

(54) INK-JET RECORDING APPARATUS

(75) Inventor: Yoshihide Hoshino, Hachioji (JP)

(73) Assignee: Konica Minolta Medical & Graphic Inc., Tokyo (JP)

( * ) Notice: Subject to any disclaimer, the term of this patent is extended or adjusted under 35 U.S.C. 154(b) by 35 days.

(21) Appl. No.: 11/691,916

(22) Filed: Mar. 27, 2007

(65) Prior Publication Data

US 2007/0188541 A1 Aug. 16, 2007

Related U.S. Application Data

(62) Division of application No. 11/032,244, filed on Jan. 10, 2005, now abandoned.

(30) Foreign Application Priority Data

Jan. 19, 2004 (JP) ..... 2004-010351

(51) Int. Cl.
*B41J 2/01* (2006.01)

(52) U.S. Cl. ..... 347/102; 347/101; 347/26

(58) Field of Classification Search ..... 347/26, 347/100, 101, 102, 5, 9, 16
See application file for complete search history.

(56) References Cited

U.S. PATENT DOCUMENTS

| | | | | |
|---|---|---|---|---|
| 4,748,453 | A | 5/1988 | Lin et al. | |
| 5,754,198 | A | 5/1998 | Nishikawa | |
| 6,092,890 | A | 7/2000 | Wen | |
| 6,113,290 | A | 9/2000 | Tanaka et al. | |
| 6,145,978 | A | 11/2000 | Kato et al. | |
| 6,164,757 | A | 12/2000 | Wen et al. | |
| 6,328,438 | B1 | 12/2001 | Ozawa | |
| 6,857,733 | B2 | 2/2005 | Issler | |
| 2004/0125162 | A1 * | 7/2004 | Valero et al. | 347/16 |
| 2005/0156965 | A1 | 7/2005 | Hoshino | |

FOREIGN PATENT DOCUMENTS

| | | | |
|---|---|---|---|
| EP | 0 963 850 | A2 | 12/1999 |
| EP | 1 350 629 | A1 | 10/2003 |
| JP | 2001-088281 | A | 4/2001 |
| JP | 2001-310454 | A | 11/2001 |
| JP | 2003-191601 | A | 7/2003 |

OTHER PUBLICATIONS

Related U.S. Appl. No. 11/032,251; filed Jan. 10, 2005; Inventor: Yoshihide Hoshino; Title: Inkjet Recording Apparatus; Patent Application Publication No. US 2005/0156965 A1.

* cited by examiner

*Primary Examiner*—Lam S Nguyen
(74) *Attorney, Agent, or Firm*—Frishauf, Holtz, Goodman & Chick, P.C.

(57) ABSTRACT

An ink-jet recording apparatus has ink jetting nozzles through each of which a photocurable ink is jetted for recording an image onto a recording material by an ink jetting method. The apparatus includes a color ink recording head for jetting color ink, a clear ink recording head for jetting clear ink; and an ink amount determining section for determining an amount of the clear ink to be jetted from the clear ink recording head, by causing at least one of the color ink recording head and the clear ink recording head to record a predetermined test pattern on the recording material, and on the basis of a glossiness of the recorded test pattern. A glossiness measuring device measures the glossiness, and the ink amount determining device determines the amount of the clear ink based on the measured glossiness.

14 Claims, 8 Drawing Sheets

| GLOSSINESS MEASUREMENT VALUE | INK AMOUNT OF CLEAR INK | | |
|---|---|---|---|
| | GLOSSINESS A | GLOSSINESS B | GLOSSINESS C |
| 0 | 6 | 2 | 18 |
| 5 | 5 | 1.5 | 15 |
| 10 | 4 | 1 | 12 |
| 15 | 3 | 0.5 | 9 |
| 20 | 2 | 0 | 6 |
| 25 | 1 | 0 | 3 |
| 30 | 0 | 0 | 0 |

| GLOSSINESS MEASUREMENT VALUE | INK AMOUNT OF CLEAR INK | | |
|---|---|---|---|
| | GLOSSINESS A | GLOSSINESS B | GLOSSINESS C |
| 0 | 6 | 2 | 18 |
| 5 | 5 | 1.5 | 15 |
| 10 | 4 | 1 | 12 |
| 15 | 3 | 0.5 | 9 |
| 20 | 2 | 0 | 6 |
| 25 | 1 | 0 | 3 |
| 30 | 0 | 0 | 0 |

INK-JET RECORDING APPARATUS

CROSS REFERENCE TO RELATED APPLICATION

The present application is a Divisional Application of U.S. application Ser. No. 11/032,244 filed Jan. 10, 2005, now abandoned, which is incorporated herein by reference.

BACKGROUND OF THE INVENTION

The present invention relates to an ink-jet recording apparatus that is equipped with ink jet nozzles for jetting photo-curable ink droplets and prints on a recording material in an ink-jet recording method.

The apparatus for recording images with UV-curable ink in the ink-jet recording method has merits such as capability of recording images on various kinds of recording media and capability of printing without printing plates, if necessary.

Patent document 1 discloses an art of image recording by an ink-jet recording method using photo-curable ink without providing an ink receiving layer on the surface of a recording material and without deteriorating the image quality due to oozing of ink.

However, the photo-curable ink will cause image fluctuation, uneven print surfaces due to differences in ink quantities, local excessive glossiness, etc. Specifically, this influence is conspicuous in the recording area where a large quantity of ink is used. Usually, when printed, most of water-based or oil-based ink is absorbed into a recording material. However, the printed photo-curable ink remains on the recording paper, and gets hardened in the state that the jetted ink is protruded from the recording paper. This is assumed to be one of the main reasons for the fluctuation of the recorded image surfaces due to the difference in the amount of jetted ink.

Patent document 2 discloses an art of ink-jet image recording using an ink-jet printer with photo-curable ink which suppresses image fluctuation and gives even glossiness to images by using both color ink which contains a colorant and clear ink which contains no colorant to equalize the quantities of inks per unit print area.

Patent Document 1 represents Japanese Non-Examine Patent Publication 2001-310454, and Patent Document 2 represents Japanese Non-Examine Patent Publication 2003-191601.

Meanwhile, in some cases, users want to give desired glossiness levels to images recorded by an ink-jet recording method.

However, the arts of Patent Documents 1 and 2 cannot give arbitrary user-requested glossiness levels to print images even when they are used together although they can give a predetermined glossiness level to print images. Therefore, the arts cannot determine whether or not to use ink containing no colorant to accomplish respective glossiness levels.

SUMMARY OF THE INVENTION

This invention has been made to solve the above problems and an object of this invention is to provide an ink-jet recording apparatus that can give arbitrary uniform glossiness levels to recorded images.

The above object can be attained by any one of the structures (1) to (18) below.

Structures (1): An ink-jet recording apparatus equipped with ink jet nozzles which jet photo-curable inks to record images on recording materials in an ink-jet method, comprising; a plurality of color ink recording heads each of which jets an ink containing a colorant (hereinafter referred to as a color ink), a clear ink recording head which jets an ink containing no colorant (hereinafter referred to as a clear ink), and an ink amount determining section which records a preset test pattern on the recording material by at least one of the color ink recording heads or the clear ink recording head, reads the glossiness of the test pattern, and determines the amount of clear ink to be jetted from the clear ink recording head.

According to structure (1), the ink-jet recording apparatus records a test pattern by at least one of the color ink recording heads and the clear ink recording head and determines the amount of clear ink to be jetted to give a desired glossiness to a recorded image. In printing, the amounts of inks jetted from the color ink recording heads and the clear ink recording head are set based on this determination. With this, arbitrary desired levels of glossiness can be given to recorded images.

Structures (2): The ink amount determining section of structure (1), varies the amount of ink to be jetted by controlling the quantity of ink or number of ink droplets to be jetted from the clear ink recording head. The ink amount can be varied most easily by a recording head that can vary the number of ink droplets or ink amount.

Structures (3): The ink amount determining section of structure (1), varies the ratio of clear ink to be jetted from the clear ink recording head to control ink amounts. With this, it is possible to record the clear ink with resolution different from that when recorded by the color ink. Therefore, the ink amount can be varied most easily by a recording head that can vary the number of ink droplets or ink amount.

Structures (4): The ink-jet recording apparatus of structure (1) is characterized by providing a means to measure the glossiness, wherein the ink amount determining section determines the amount of the clear ink according tot the result of measurement by this glossiness measuring means.

According to structure (4), the ink-jet recording apparatus can determine the amount of clear ink to give objectively exact arbitrary glossiness because the glossiness measuring means measures the glossiness of a test pattern and determines the amount of the clear ink.

Structures (5): In structure (4), the glossiness measuring means is characterized by emitting light to the test pattern and reading light reflected on the test pattern.

According to structure (5), the ink-jet recording apparatus enables measurement of the glossiness of a test pattern with a simple configuration.

Structures (6): In Structure (4), the glossiness measuring means measures the glossiness of a blank area of the recording material where the test patter has not been recorded and the ink amount determining section compares the glossiness of the test pattern with the glossiness of the blank area and determines the amount of clear ink to be jetted according to the result of this comparison.

According to structure (6), the ink-jet recording apparatus enables provision of uniform glossiness on both a recorded portion on the recording material and a non-recorded portion of the recording material, namely the recording material itself, where the test pattern has not been recorded, because the glossiness measuring means measures the glossiness of the recording material itself and the ink amount determining section compares the glossiness of the recording material itself with the glossiness of the test pattern after recording and determines the amount of clear ink to be jetted according to the result of this comparison.

Structures (7): The ink-jet recording apparatus according to structure (4) is equipped with a means for conveying a recording material and records by the color ink recording heads and the clear ink recording head which are disposed in that order downstream of the movement of the recording material while carrying the recording material. The ink-jet recording apparatus is characterized in that the glossiness measuring means is provided in the downstream side of the clear ink recording head and measures the glossiness of the recorded test pattern.

According to structure (7), the ink-jet recording apparatus having the ink recording heads disposed in a line perpendicular to the movement of the recording material, is characterized in that the glossiness measuring means measures the glossiness of a test pattern after it is printed. This enables measurement of the glossiness of a test pattern while printing the test pattern and quick calculation of an amount of clear ink.

Structures (8): The ink-jet recording apparatus of structure (7) is characterized in that a scanning means is provided to drive the glossiness measuring means to scan over the recording material.

According to structure (8), the ink-jet recording apparatus having the ink recording heads disposed in a line perpendicular to the movement of the recording material, can measure the glossiness of the whole surface of the recording material independently of its configuration.

Structure (9): The ink-jet recording apparatus of structure (4) comprising a means for conveying the recording material and a means for driving the color ink recording heads and the clear ink recording head to scan to repeat scanning by the scanning means and conveying by the conveying means is characterized in that the glossiness measuring means is provided upstream of the clear ink recording head in the scanning direction or downstream of the clear ink recording head in a material conveyance direction and measures the glossiness of the recorded test pattern.

According to structure (9), the ink-jet recording apparatus of a serial recording method which drives ink recording heads to scan and record on the recording material, can measure the glossiness of a test pattern after it is printed. This enables measurement of the glossiness of a test pattern while printing the test pattern and quick calculation of an amount of clear ink.

Structure (10): The ink-jet recording apparatus of structure (9) is characterized in that a means for moving the color ink recording heads and the clear ink recording head is provided and that this head moving means also moves the glossiness measuring means over the recording material.

According to structure (10), the ink-jet recording apparatus of a serial recording method which drives the ink recording heads to scan and record on the recording material enables measurement of the glossiness over the whole surface of the recording material.

Structure (11): The ink-jet recording apparatus of structure (9), is characterized by providing a means to drive the glossiness measuring means to scan over the recording material.

According to structure (11), the ink-jet recording apparatus having the ink recording heads disposed in a line perpendicular to the movement of the recording material, enables measurement of the glossiness of the whole surface of the recording material independently of its configuration.

Structure (12): The ink-jet recording apparatus of any of structures (1) to (10) is characterized in that the test pattern contains plural ink amount recording areas containing different clear ink amounts per unit area from each other.

According to Structure (12), the ink-jet recording apparatus enables determination of the amount of clear ink to give desired glossiness level to a recorded image by printing test patterns containing different clear ink amounts per unit area from each other and comparing glossiness of each test pattern.

Structure (13): In structure (12), the clear ink recording areas are characterized in that their ink amounts are controlled by varying amounts of ink or the number of ink droplets jetted from the clear ink recording head. Therefore, the ink amounts of test patterns can be varied most easily by a recording head that can vary the number of ink droplets or ink amount.

Structure (14): In structure (12), the clear ink recording areas is characterized in that their ink amounts are controlled by changing the duty cycle of clear ink jetted from the clear ink recording head. With this, it is possible to record the clear ink with resolution different from that when recorded by the color ink. Therefore, the ink amounts of test patterns can be varied most easily by a recording head that jets a preset number of ink droplets or a preset amount of ink.

Structure (15): The ink-jet recording apparatus of any of structures (1) to (12) is characterized in that the ink-jet recording apparatus is equipped with a plurality of color ink recording heads in accordance with different color inks and uses these recording heads singly or in combination to record with the maximum ink amount per unit area.

According to Structure (15), the ink-jet recording apparatus enables determination of the amount of clear ink under a condition which affects recording most greatly by irregularities and glossiness of images, or under a condition which uses a maximum amount of color ink. For example, structure (15) enables determination of optimum amounts of inks to correct irregularities and glossiness on solid images of primary or secondary color.

Structure (16): The ink-jet recording apparatus of any of structures (1) to (15), the test pattern contains a plurality of areas containing different ink amounts per unit area of each color ink.

According to structure (16), although different ink amounts per unit area of each color ink are apt to cause image irregularities and glossiness fluctuation, structure (16) enables determination of amounts of clear ink to eliminate these irregularities and fluctuation, for example, determination of amounts of the clear ink to correct irregularities and glossiness fluctuation due to gradations.

Structure (17): The ink-jet recording apparatus of any of structures (1) to (16), the color inks contain colorants of at least cyan, magenta, yellow, and black.

According to structure (17), the above-stated effect can be obtained by the ink-jet recording apparatus using inks of basic colors of cyan, magenta, yellow, and black.

Structure (18): The ink-jet recording apparatus of any of structures (1) to (17), the color inks and the clear ink can be cured by ultra-violet rays. The ink-jet recording apparatus is characterized by further providing a UV light irradiation device to harden the inks.

According to structure (18), the above-stated effect can be obtained by the ink-jet recording apparatus using UV curable inks.

According to structure (1), the ink-jet recording apparatus can give arbitrary uniform glossiness levels to recorded images by determining the amount of the clear ink to give arbitrary desired glossiness to images according to the glossiness of a test pattern recorded by at least one of the colored and clear ink recording heads, setting the amounts of inks jetted from the color ink recording heads and the clear ink recording head according to this determination, and recording images with the ink amounts.

According to structure (2), the ink amounts can be varied most easily by a recording head that jets a preset number of ink droplets or a preset amount of ink.

According to structure (3), the ink amounts can be varied most easily by a recording head that jets a preset number of ink droplets or a preset amount of ink.

According to structure (4), the ink-jet recording apparatus can determine the amount of clear ink to give objectively exact arbitrary glossiness because the glossiness measuring means measures the glossiness of a test pattern and determines the amount of the clear ink.

According to structure (5), the ink-jet recording apparatus enables measurement of glossiness of test patterns by a simple and easy configuration.

According to structure (6), the ink-jet recording apparatus can equalize glossiness of recorded areas and non-recorded areas of a recording material by measuring the glossiness of a recording material which does not have a test pattern on it, that is, the glossiness of the recording material itself by the glossiness measuring means, comparing this glossiness with the glossiness of a recorded material which has a test pattern on it by the ink amount determining section, and determining the amount of the clear ink by the result of comparison.

According to structure (7), in the ink-jet recording apparatus having the ink recording heads disposed in a line perpendicular to the movement of the recording material, the glossiness measuring means measures the glossiness of a test pattern after the test pattern is recorded. This enables measurement of the test pattern while recording the test pattern and quick calculation of an amount of clear ink.

According to structure (8), the ink-jet recording apparatus having the recording heads disposed in a line perpendicular to the movement of the recording material can measure the glossiness of the whole surface of the recording material independently of its configuration.

According to structure (9), in the ink-jet recording apparatus of a serial recording method which drives ink recording heads to scan and record on the recording material, the glossiness measuring means measures the glossiness of a test pattern after the test pattern is recorded. This enables measurement of the test pattern while recording the test pattern and quick calculation of an amount of clear ink.

According to structure (10), the ink-jet recording apparatus of a serial recording method which drives the ink recording heads to scan and record on the recording material enables measurement of the glossiness over the whole surface of the recording material.

According to structure (12), the ink-jet recording apparatus enables determination of the amount of clear ink to give arbitrary desired glossiness level to a recorded image by printing test patterns containing different clear ink amounts per unit area and comparing glossiness of each test pattern.

According to structure (13), the ink amount of the test patterns can be varied most easily by a recording head that can vary the number of ink droplets or ink amount.

According to structure (14), the ink amount of the test patterns can be varied most easily by a recording head that can vary the number of ink droplets or ink amount.

According to structure (15), the ink-jet recording apparatus enables determination of the amount of clear ink under a condition which affects recording most greatly by irregularities and glossiness of images, or under a condition which uses a maximum amount of color ink. For example, structure (15) enables determination of optimum amounts of inks to correct irregularities and glossiness on solid images of primary or secondary color.

According to structure (16), although different ink amounts per unit area of each color ink are apt to cause image irregularities and glossiness fluctuation, the ink-jet recording apparatus enables determination of amounts of clear ink to eliminate these irregularities and fluctuation, for example, determination of amounts of the clear ink to correct irregularities and glossiness fluctuation due to gradations.

According to structure (17), the above-stated effect can be obtained by the ink-jet recording apparatus using inks of basic colors of cyan, magenta, yellow, and black.

According to structure (18), the above-stated effect can be obtained by the ink-jet recording apparatus using UV curable inks.

DETAILED DESCRIPTION OF THE PREFERRED EMBODIMENT

The preferred embodiments of this invention will be described below with reference to the accompanying drawings. However, it is to be understood that the invention is not limited to these specific embodiments.

Figure 1:
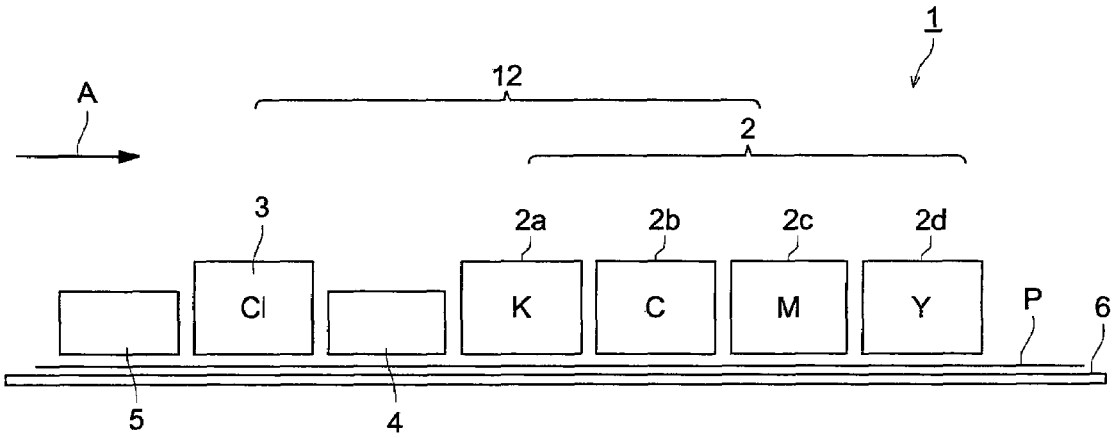
FIG. 1 shows the main portion of an ink-jet recording apparatus which is the first embodiment of this invention.

Referring to FIG. 1 is explained the main configuration of the ink-jet recording apparatus which is a preferred embodiment of this invention. FIG. 1 shows the main portion of the ink-jet recording apparatus.

The ink-jet recording apparatus 1 is of the serial type which of ink-jet recording apparatus which jets UV-curable inks onto a recording material to form an image while driving the recording heads to scan the recording material. The ink-jet recording apparatus 1 is equipped with a platen 6 to support a recording material P from under it and a conveyance device 7 (see FIG. 2) to convey the recording material P from the platen 6. Further above the platen 6, the ink-jet recording apparatus 1 is equipped with a carriage 8 (see FIG. 5) as a head carrying means to move the recording heads 12 and light irradiation devices 4 and 5 perpendicularly to the movement of the recording material P.

The carriage 8 disposes a plurality of recording heads along the scanning direction A to jet inks towards the recording material P on the platen 6. These recording heads 12 is constituted by a clear ink recording head 3 for jetting a clear ink (C1) which contains no colorant and color ink recording heads 2 for jetting color inks each of which contains a colorant. As the ink-jet recording apparatus uses a black ink (K) which contains a black colorant and inks of the other colorants as the color inks, the color ink recording heads 2 is constituted by a black ink recording head 2*a* which jets a black ink (K), a cyan ink recording head 2*b* which jets a cyan ink (C), a magenta ink recording head 2*c* which jets a magenta ink (M), and a yellow ink recording head 2*d* which jets a yellow ink (Y).

The carriage 8 has light irradiation devices 4 and 5 on both sides, namely one near the color ink recording heads 2 and the other on the opposite side, of the clear ink recording head 3 to emit light containing UV rays to the recording material P.

Figure 2:
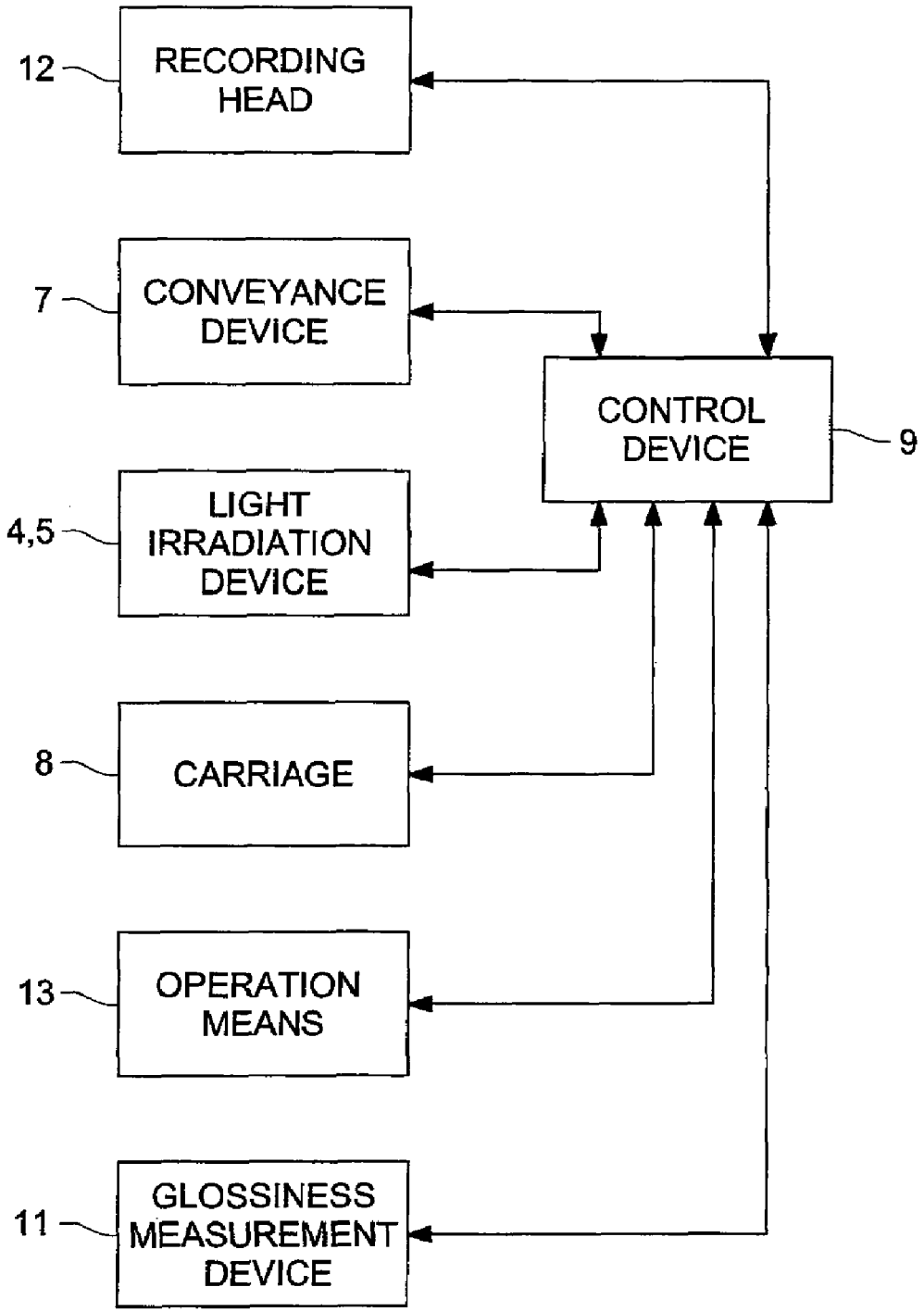
FIG. 2 shows the functional block diagram of a control device of the first embodiment.

FIG. 2 shows the functional block diagram of a main control portion of the ink-jet recording apparatus 1. As shown in FIG. 2, the ink-jet recording apparatus 1 is equipped with a control device 9 which determines the amount of clear ink and controls respective moving parts. The control device 9 is constituted by an interface unit, a recording circuit, a CPU, and so on and controls devices connected to the interface unit according to the control programs and control data that are stored in the recording circuit.

The conveyance device 7, the driving sources of the carriage 8 and recording head 12, the light sources of the light irradiation devices 4 and 5, and the operation means 13 moving the glossiness measuring means 11 along the main scanning direction on the recording material P are electrically connected to the interface unit. In addition to these, respective driving parts of the ink-jet recording apparatus 1 are also connected to this interface unit.

Next will be explained the amount of the clear ink to be jetted.

This invention determines the amount of the clear ink to be jetted according to the required glossiness of a recorded image. So, this embodiment records a preset test pattern on the recording material P and measures the glossiness of this test pattern.

Figure 3:
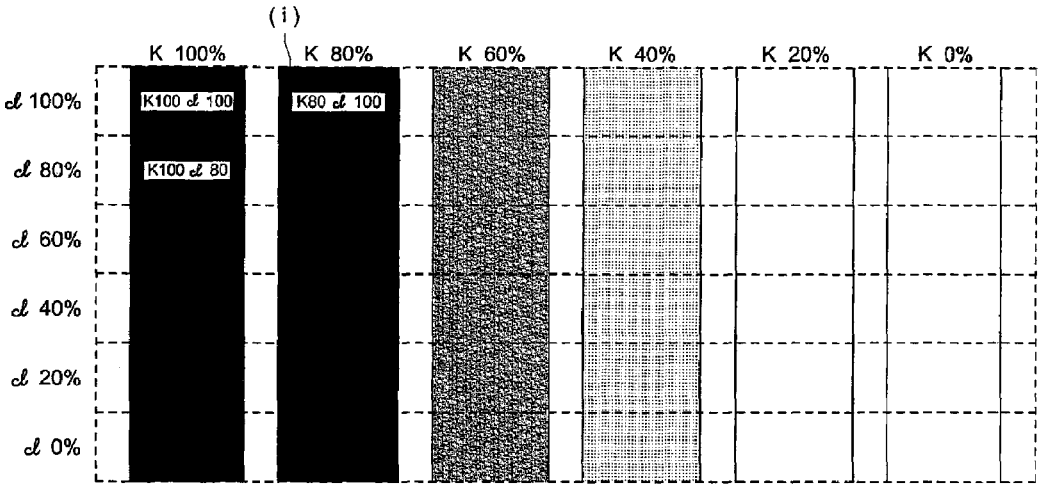
FIG. 3(*a*) and FIG. 3(*b*) respectively show test patterns used in the first embodiment of this invention.
Figure 3:
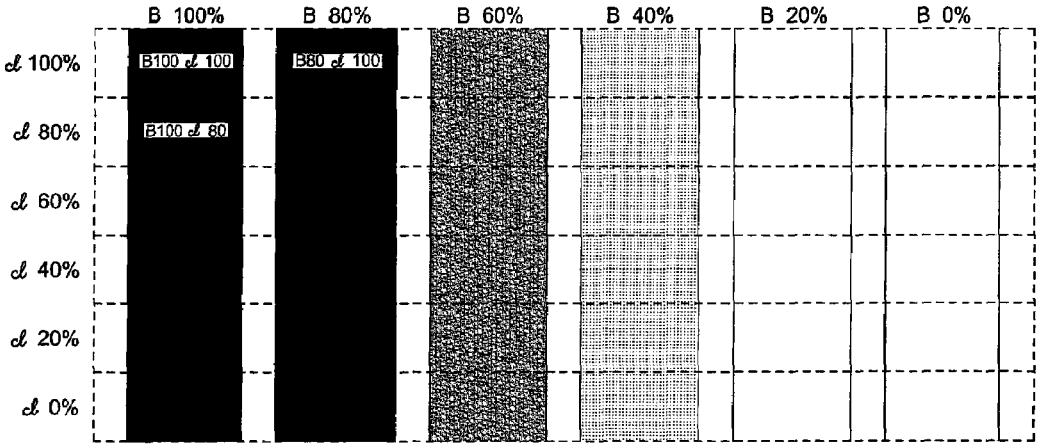

FIG. 3(*a*) and FIG. 3(*b*) show test patterns used in the first embodiment of this invention. The test pattern of FIG. 3(*a*) varies the amount of the black ink (K) horizontally and the amount of the clear ink vertically. For example, the area (i) shows a combination of 80% of the black ink (K) and 100% of the clear ink (Cl). Similarly, the test pattern of FIG. 3(*b*) shows a table of blue areas (B) made by combinations of magenta ink (M) and cyan ink (C). Although FIG. 3(*a*) and FIG. 3(*b*) show examples of test patterns of black (K) and blue (B), test patterns of all colors can be prepared if color inks have different glossiness when hardened.

Figure 4:
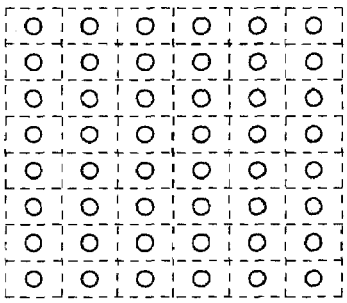
FIG. 4(*a*) to FIG. 4(*c*) respectively show changes of ink amounts in the first embodiment of this invention.
Figure 4:
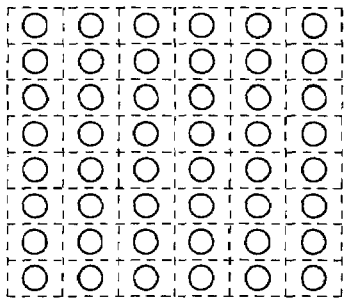
Figure 4:
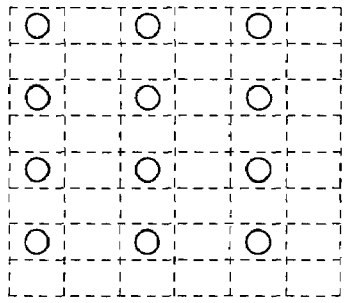

FIG. 4(*a*) to FIG. 4(*c*) are explanatory drawings showing changes of clear ink amounts in the first embodiment of this invention. Examples of FIG. 4(*a*) and FIG. 4(*b*) change clear ink amounts by varying the amount of each ink droplet or the number of ink droplets jetted from the clear ink recording head at identical resolutions. The example of FIG. 4(*c*) varies the ink amount by controlling the duty cycle of ink jetted from the recording head and reducing the recording ratio relative to the recording resolution.

Figure 5:
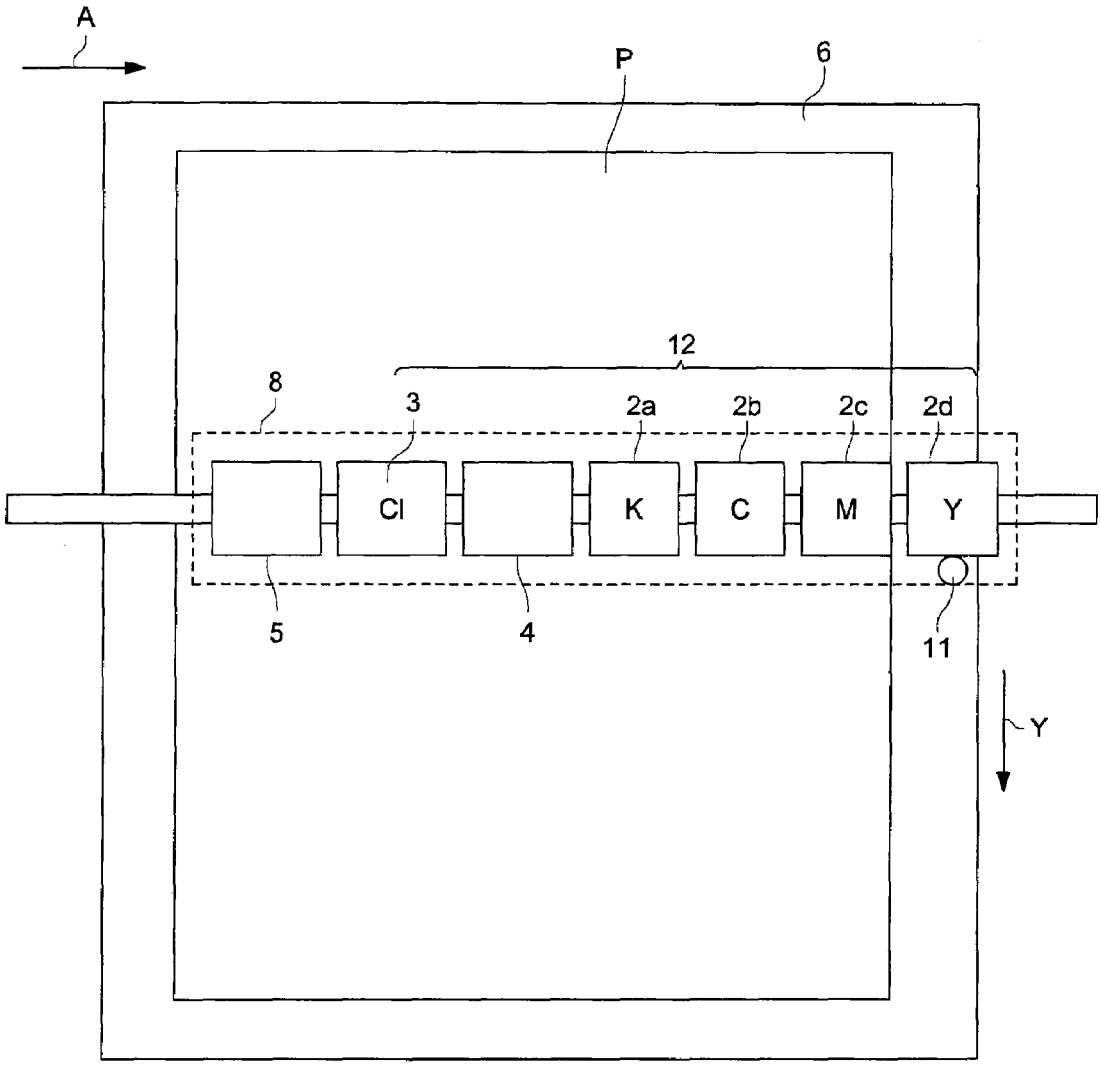
FIG. 5 shows the top view of the main portion of an ink-jet recording apparatus which is the first embodiment.

FIG. 5 shows that the carriage 8 has a glossiness measuring means 11 to measure the glossiness of a test pattern. The glossiness measuring means 11 is constituted by, for example, a light emitting portion which emits light of a predetermined wavelength and a light receiving portion which receives light reflected on the test pattern. The movement of the glossiness measuring means 11 is controlled by the operation device of FIG. 2. Further, the glossiness measuring means 11 is preferably provided in the downstream side of the recording head 12 relative to the movement Y of the recording material P.

As the ink-jet recording apparatus is so designed that the glossiness measuring means measures the glossiness of a test pattern after the test pattern is recorded, the ink-jet recording apparatus can measure the glossiness of the test pattern while recording the pattern and calculates the amount of the clear ink quickly.

The test pattern can contain a plurality of areas having different clear ink amounts per unit area. In this case, the ink-jet recording apparatus can determine amounts of clear ink to give arbitrary desired glossiness by recording a test pattern having different amounts of clear ink per unit area and comparing the glossiness of respective areas of the test patterns simultaneously.

The ink-jet recording apparatus can also determine the amounts of the clear ink under the condition which affects recording most greatly by irregularities and glossiness on images, or under the condition which uses a maximum amount of color ink. In this case, for example, the ink-jet recording apparatus can determine optimum amounts of the clear ink to correct irregularities and glossiness on solid images of primary or secondary color.

It is preferable that the test pattern contains a plurality of areas containing different ink amounts per unit area of each color ink.

Although different ink amounts per unit area of each color ink are apt to cause image irregularities and glossiness fluctuation in this case, the ink-jet recording apparatus can determine amounts of clear ink to eliminate these irregularities and fluctuation, for example, determine amounts of the clear ink to correct irregularities and glossiness fluctuation due to gradations.

The glossiness of a test pattern is measured by applying a light from the light emitting part of the glossiness measuring means 11 to the recording material at a preset incident angle θ and receiving the reflected light by the light receiving part. In this case, the ratio of a reflected light intensity to an incident light intensity (reflected light intensity divided by incident light intensity) at an incident angle of, for example, 45 degrees is called a 45-degree glossiness. Similarly, the ratio at 60 degrees is called a 60-degree glossiness. The measured value (the measured glossiness value) is sent to the control device 9 (see FIG. 2) and used to determine the amount of ink to be jetted from the clear ink recording head 3 in the recording head assembly 12.

In this case, it is also preferable that the amount of the clear ink is determined by measuring the glossiness of a recording material which does not have a test pattern on it, that is, the glossiness of the recording material itself by the glossiness measuring means 11 and comparing this measured glossiness by the glossiness of a recorded material which has a test pattern on it by the ink amount determining section. With this, the recorded areas and non-recorded areas on a recording material can have a uniform glossiness.

Figures 6, 7:
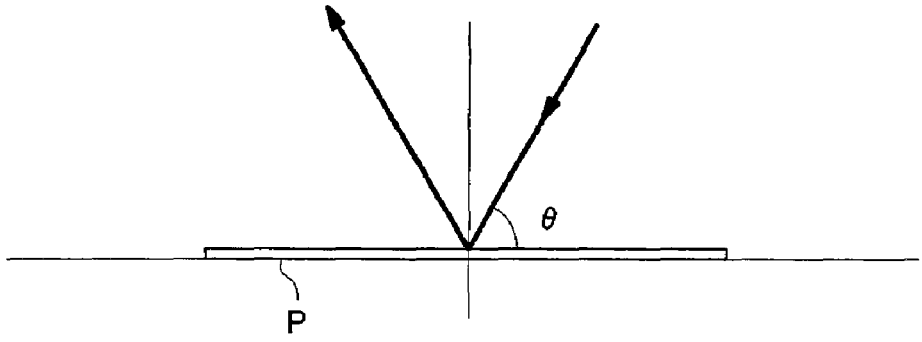
FIG. 6 is an explanatory drawing of measurement of glossiness in the embodiment of this invention.
FIG. 7 is a sample table showing the relationship between amounts of clear ink and measured glossiness values to be set in the embodiment of this invention.

FIG. 7 is a sample table showing the relationship between amounts of clear ink and measured glossiness values to be set, that is, amounts (pico-liters (pl)) of clear ink required to give glossiness A to C for respective measured glossiness values. For example, this table shows that 5 pl of clear ink is required to give the glossiness A when the measured glossiness value is 5.

The control device 9 determines amounts of clear ink required to give arbitrary desired glossiness from the measured glossiness values and a table like FIG. 7 and controls the amount of clear ink jetted from the clear ink recording head.

Next will be explained the operation of the ink-jet recording apparatus 1 of this embodiment.

The control device 9 controls the conveyance device 7 to intermittently convey the recording material P when image recording timing comes. When the recording material P stops in this intermittent, the control device 9 controls the carriage 8 to move the recording head 12 to scan the recording material P. When the carriage 8 moves to scan, the control device 9 controls the recording head 12 to jet inks from respective recording heads and the light irradiation devices 4 and 5 to emit light toward the recording material P. With this, an image is formed on the recording material P.

When the carriage 8 moves to scan in the main scanning direction A of FIG. 1 and FIG. 5, the light irradiation device 4 in the upstream side of the main scanning direction emits light to harden color inks (Y, M, C, and K) on the recording material P and the light irradiation device 5 in the downstream side emits light to harden the clear ink on the recording material P.

This embodiment has a main scanning direction from left to right on the drawing. However, the main scanning can be made in the reverse direction or in both directions. However, when the main scanning is made in the reverse direction, a light irradiation device to harden color inks instead of the light irradiation device 5 must be provided in the downstream side of the color ink recording head 2 relative to the main scanning direction. When the main scanning is made in both directions, an additional light irradiation device to harden the color inks (besides the light irradiation devices 4 and 5) must be provided next to the outermost yellow ink recording head 2*d*.

"Hardening" used here implies to completely harden all part of each ink droplet on the recording material P. However, it can be "initial hardening" which hardens only the surface of each ink droplet fully enough to prevent it from being mingled with the other ink droplets.

In this configuration, when the carriage 8 moves in the main scanning direction A, the recording heads 2*d* (yellow ink), 2*c* (magenta ink), 2*b* (cyan ink), and 2*a* (black ink) respectively jet inks on to the recording material P in that order. The color inks on the recording material P are hardened by the light irradiation device 4. Then, the proper amounts of clear ink are jetted to the recording material P from the clear ink recording head 3 and hardened by the light irradiation device 5. Then, the recording material P is intermittently sent along the direction Y of material conveyance.

The above processes are repeated to form a complete image on the recording material P.

Before this image recording on the recording material P, a test pattern is recorded on the recording material P. The control device 9 determines the proper quantity of clear ink according to the result of measurement of glossiness reflected on the test pattern to give arbitrary desired glossiness to the image.

Specifically, the control device 9 controls the operation of the recording heads 12, the light irradiation devices 4 and 5, the conveyance device 7, and the carriage 8 to form a preset test pattern on the recording material P. Next, the control device 9 controls the operation means 13 and the glossiness measuring means 11 to cause the glossiness measuring means 11 to measure the glossiness of the test pattern. The control device 9 receives the measured glossiness values from the glossiness measuring means 11 and determines the proper amounts of clear ink from the values and a table like FIG. 7 to give an arbitrary desired glossiness level to the image.

The clear ink recording head 3 in the recording head assembly 12 controls the amount of clear ink to the amount determined by the control device 9.

Figure 8:
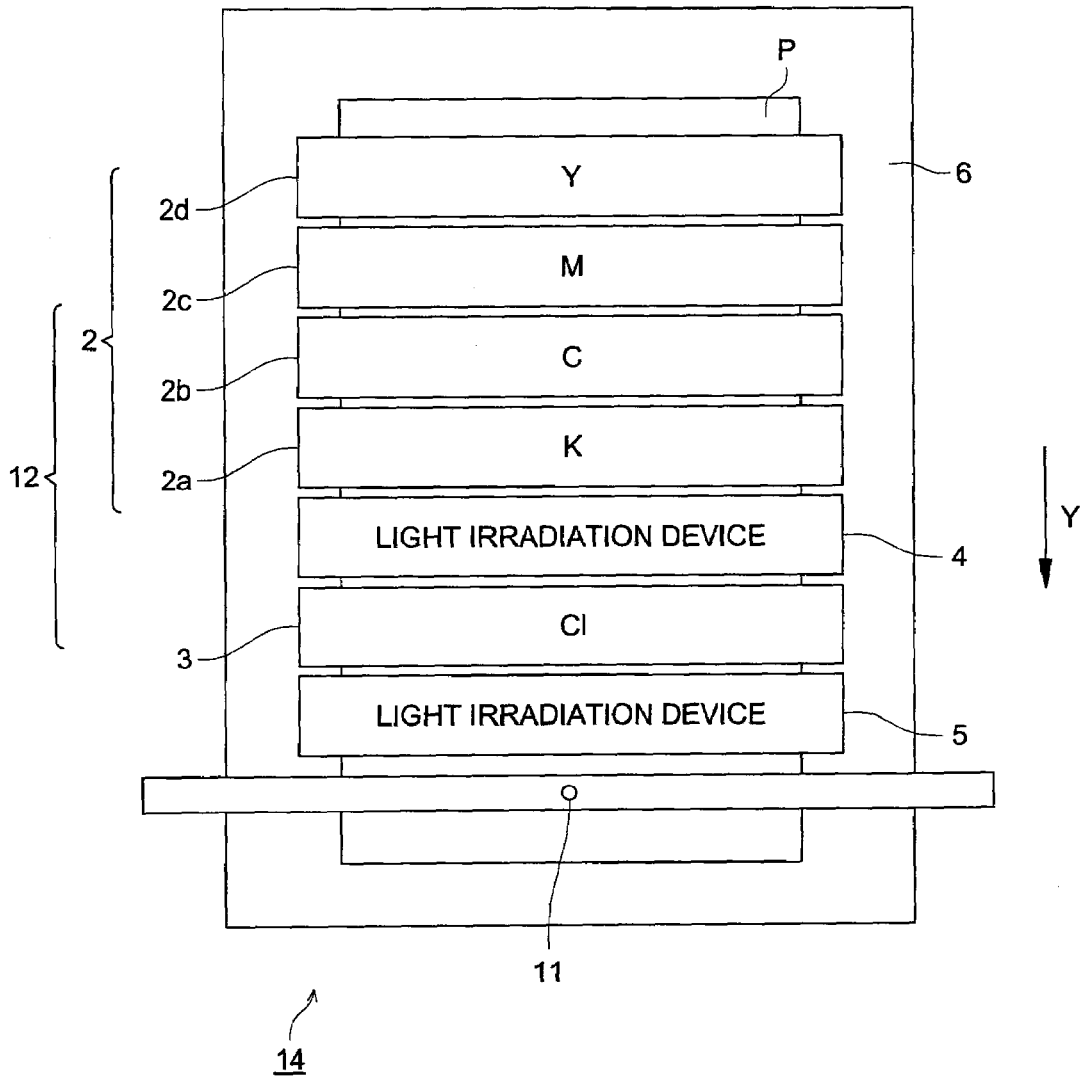
FIG. 8 shows the top view of the main portion of an ink-jet recording apparatus which is the second embodiment of this invention.

FIG. 8 shows the top view of the main portion of an ink-jet recording apparatus which is the second embodiment of this invention. The ink-jet recording apparatus 14 is of the line type which forms an image on a recording material P by jetting UV-curable inks from a stationary recording heads 12 to a recording material P which is running along the direction Y of material conveyance.

The ink-jet recording apparatus 14 is equipped with a platen 6 to support each recording material P from the bottom and a conveyance device 7 (see FIG. 9) to convey the recording material P from the platen 6.

Further above the platen 6, the ink-jet recording apparatus 1 is equipped with a set of recording heads 12. The set of recording heads 12 is constituted by a clear ink recording head 3 which jets an ink containing no colorant and some color ink recording heads 2 which respectively jet inks containing colorants. As the ink-jet recording apparatus 1 uses a black ink (K) which contains a black colorant and inks of the other colorants as the color inks, the color ink recording heads 2 is constituted by a black ink recording head 2*a* which jets a black ink (K), a cyan ink recording head 2*b* which jets a cyan ink (C), a magenta ink recording head 2*c* which jets a magenta ink (M), and a yellow ink recording head 2*d* which jets a yellow ink (Y).

Above the platen 6 there are provided the light irradiation devices 4 and 5 on both sides, that is, one near the color ink recording heads 2 and the other on the opposite side, of the clear ink recording head 3 to emit light containing UV rays to the recording material.

Figure 9:
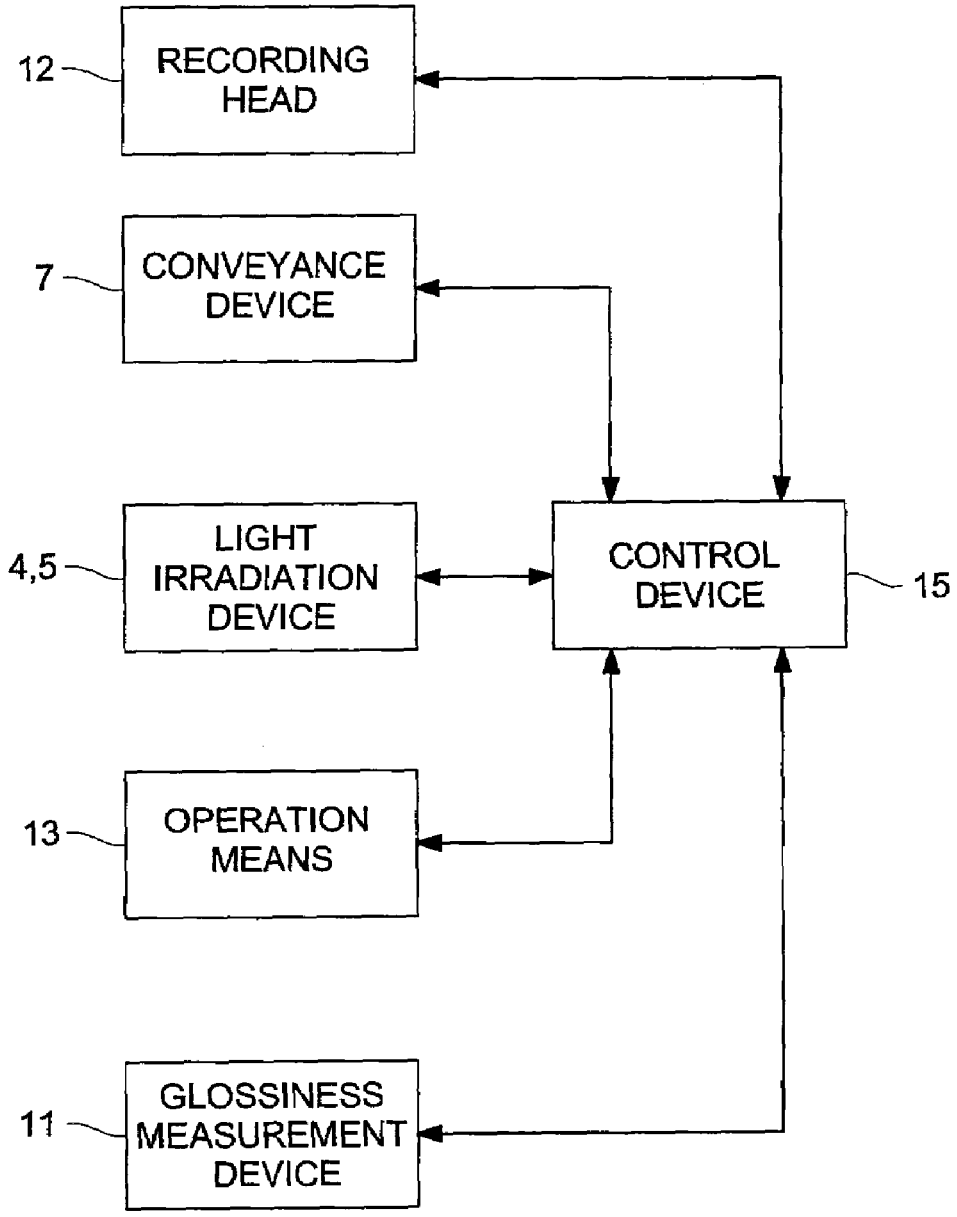
FIG. 9 shows the functional block diagram of a control device of the second embodiment.

FIG. 9 shows the functional block diagram of a main control portion of the ink-jet recording apparatus 14. As shown in FIG. 9, the ink-jet recording apparatus 14 as well as the ink-jet recording apparatus 1 of the first embodiment is equipped with a control device 15 which determines the amounts of clear ink droplets and controls respective moving parts. The control device 15 is constituted by an interface unit, a recording circuit, a CPU, and so on and controls devices connected to the interface unit according to the control programs and control data that are stored in the recording circuit.

The conveyance device 7, the driving source of the recording head 12, the light sources of the light irradiation devices 4 and 5, and the operation means 13 moving the glossiness measuring means 11 of FIG. 5 perpendicularly to the direction Y of material conveyance on the recording material P are electrically connected to the interface unit. In addition to these, respective driving parts of the ink-jet recording apparatus 14 is also connected to this interface unit.

As shown in FIG. 8, a glossiness measuring means 11 to measure the glossiness of a test pattern is provided in the downstream side of the recording heads 12 relative to the direction Y of material conveyance. The glossiness measuring means 11 is constituted by, for example, a light emitting portion which emits light of a predetermined wavelength and a light receiving portion which receives light reflected on the test pattern. The movement of the glossiness measuring means 11 is controlled by the operation means 13.

Also in this embodiment as well as the first embodiment, the control device 15 determines optimum amounts of clear ink to give arbitrary desired glossiness levels to a recorded image according to the glossiness measured by the glossiness measuring means 11. The recording heads 12 are controlled to set amounts of clear inks as determined by the control device.

Next will be explained the operation of the ink-jet recording apparatus 14 of this embodiment.

When image recording timing comes, the control device 15 controls the conveyance device 7 to convey the recording material P in the direction Y of material conveyance, controls the recording heads 12 to respectively jet inks and the light irradiation devices 4 and 5 to emit light towards the recording material P to form an image on the recording material P.

The light irradiation device 4 in the upstream side relative to the direction of material conveyance hardens color inks (Y, M, C, and K) on the recording material P and the light irradiation device 5 in the downstream side hardens clear inks on the recording material P. "Hardening" here implies what is explained above.

This set of ink jet and hardening is repeated to complete an image on the recording material P.

Before this image recording on the recording material P, a test pattern is recorded on the recording material P. The control device 15 determines the proper quantity of clear ink according to the result of measurement of glossiness reflected on the test pattern to give arbitrary desired glossiness to the image.

Specifically, the control device 15 controls the operation of the recording heads 12, the light irradiation devices 4 and 5, and the conveyance device 7 to form a preset test pattern on the recording material P.

Next, the control device 15 controls the operation means 13 and the glossiness measuring means 11 to cause the glossiness measuring means 11 to measure the glossiness of the test pattern. The control device 15 receives the measured glossiness values from the glossiness measuring means 11 and determines the proper amounts of clear ink from the values and a table like FIG. 7 to give an arbitrary desired glossiness level to the image.

The recording head assembly 12 is controlled so that the clear ink recording head 3 may jet clear ink of an amount determined by the control device 15.

The ink-jet recording apparatus in accordance with this embodiment records a test pattern by at least one of the color ink recording heads 2 and the clear ink recording head 3 and determines the amount of clear ink to be jetted to give a desired glossiness to a recorded image. In printing, the amounts of inks jetted from the color ink recording heads 2 and the clear ink recording head 3 are set based on this determination. With this, arbitrary desired levels of glossiness can be given to recorded images.

Further, as the glossiness measuring means 11 measures the glossiness of a test pattern after the test pattern is recorded, it is possible to set the amounts of clear ink required to give objectively exact arbitrary glossiness levels.

As the glossiness measuring means 11 is constituted by a light emitting portion and a light receiving portion, the glossiness measuring means 11 can measure the glossiness of test patterns easily and simply.

Further in this embodiment, the glossiness measuring means 11 measures the glossiness of a recording material which does not have a test pattern on it, that is, the glossiness of the recording material itself and the ink amount determining section compares this measured glossiness with the glossiness of a recorded material which has a test pattern on it and determines the required amount of clear ink according to the result of comparison. With this, the recorded areas and non-recorded areas on a recording material can have a uniform glossiness.

Further as the glossiness measuring means 11 measures glossiness of a test pattern after it is printed, it is possible to measure the glossiness of a test pattern while printing the test pattern. This enables quick calculation of clear ink amounts.

With a carriage 8 as a head conveying means for moving the color ink recording head 2 and the clear ink recording head 3 to move the glossiness measuring means to scan the recording material P as in the first embodiment, the serial type ink-jet recording apparatus that moves the recording heads over the recording material P can measure the glossiness levels of all over the recording material P.

With an operation means 13 as a means for moving the glossiness measuring means 11 to scan the recording material P as in the second embodiment, the line type ink-jet recording apparatus having the ink recording heads disposed in a line perpendicular to the movement of the recording material can measure the glossiness levels of all over the recording material P independently of the configuration.

Further, the test pattern in this embodiment can contain areas of different clear ink amounts per unit area. In this case, the amounts of clear ink can be determined to give arbitrary desired glossiness level to a recorded image by recording the test pattern containing such areas and comparing glossiness levels obtained from the test pattern.

Using this test pattern, it is also possible to determine the amount of clear ink under a condition which affects recording most greatly by irregularities and glossiness of images, that is, under a condition which uses a maximum amount of color ink. For example, this enables determination of optimum amounts of inks to correct irregularities and glossiness on solid images of primary or secondary color.

It is preferable that the test pattern contains a plurality of areas containing different ink amounts per unit area of each color ink. In this case, although different ink amounts per unit area of each color ink are apt to cause image irregularities and glossiness fluctuation in this case, the ink-jet recording apparatus can determine amounts of clear ink to eliminate these irregularities and fluctuation, for example, determine amounts of the clear ink to correct irregularities and glossiness fluctuation due to gradations.

Further, this embodiment uses color inks containing cyan, magenta, yellow, and black colorants. With this, the above stated effects can be obtained in the ink-jet recording apparatus using inks of basic colors of cyan, magenta, yellow, and black.

In accordance with this embodiment, the above-stated effect can be obtained by the ink-jet recording apparatus using UV curable inks.

The embodiments of this invention have been described above. However, it is to be understood that the invention is not limited to these specific embodiments and that changes and variations may be made without departing from the spirit or scope of this invention.

What is claimed is:

1. An inkjet recording apparatus provided with ink jetting nozzles through each of which a photocurable ink is jetted for recording an image onto a recording material by an ink jet recording method, the apparatus comprising:

a color ink recording head for jetting color ink;

a first light irradiation device for emitting light to harden the jetted color ink on the recording material;

a clear ink recording head for jetting clear ink;

a second light irradiation device for emitting light to harden the jetted clear ink on the recording material;

an ink amount determining section for determining an amount of the clear ink to be jetted from the clear ink recording head, by causing at least one of the color ink recording head and the clear ink recording head to record a predetermined test pattern on the recording material, and determining the amount of the clear ink based on a glossiness of the recorded test pattern;

a glossiness measuring device for measuring the glossiness, wherein the ink amount determining device determines the amount of the clear ink based on a result measured by the glossiness measuring device; and a conveyance device for conveying the recording material, wherein an image is recorded on the recording material while the recording material is conveyed by the conveyance device;

wherein the color ink recording head, the first light irradiation device, the clear ink recording head, the second light irradiation device, and the glossiness measuring device are arranged in the stated order along a downstream direction of a conveyance direction of the recording material; and wherein the glossiness measuring device measures the glossiness of the recorded test pattern.

2. The inkjet recording apparatus of claim 1, wherein the glossiness measuring device irradiates light onto the test pattern, and reads the light reflected from the test pattern.

3. The inkjet recording apparatus of claim 1, wherein the glossiness measuring device measures a glossiness in an area where the test pattern has not been recorded, and the ink amount determining device compares the glossiness of the recorded test pattern with the glossiness in the area, and determines the amount of the clear ink according to a comparison result.

4. The inkjet recording apparatus of claim 1, further comprising a scanner for scanning the glossiness measuring device over the recording material.

5. The inkjet recording apparatus of claim 1, wherein the color ink recording head comprises a plurality of color ink recording heads corresponding to a plurality of kinds of color ink, and the plurality of color ink recording heads record an image at a maximum amount of color ink per unit area, when the image is recorded by each or a combination of the plurality of kinds of color ink.

6. The inkjet recording apparatus of claim 1, wherein the test pattern includes a plurality of recording areas for the color ink in which an amount of the color ink per unit area is different from each other.

7. The inkjet recording apparatus of claim 1, wherein the color ink comprises color inks including at least one of colorants of cyan, magenta, yellow and black.

8. The inkjet recording apparatus of claim 1, wherein the ink amount determining section varies the amount of the clear ink by changing the amount of the jetted clear ink.

9. The inkjet recording apparatus of claim 1, wherein the ink amount determining section varies the amount of the clear ink by changing the number of droplets jetted from the clear ink recording head.

10. The inkjet recording apparatus of claim 1, wherein the ink amount determining section varies the amount of the clear ink by changing a duty cycle of jetting of ink from the clear ink recording head.

11. The inkjet recording apparatus of claim 1, wherein the test pattern includes a plurality of recording areas for the clear ink in which an amount of the clear ink per unit area is different from each other.

12. The inkjet recording apparatus of claim 11, wherein the amount of the clear ink of each of the plurality of recording areas is varied by changing the amount of the jetted clear ink.

13. The inkjet recording apparatus of claim 11, wherein the amount of the clear ink of each of the plurality of recording areas is varied by changing the number of droplets jetted from the clear ink recording head.

14. The inkjet recording apparatus of claim 11, wherein the amount of the clear ink of each of the plurality of recording areas is varied by changing a duty cycle of jetting of ink from the clear ink recording head.

* * * * *